US006202837B1

(12) United States Patent
Mason et al.

(10) Patent No.: US 6,202,837 B1
(45) Date of Patent: Mar. 20, 2001

(54) BRUSH TUB

(75) Inventors: Marty Mason, Mendham; Shirley Miller, Sparta; Sheldon Schmidt, Paramus, all of NJ (US)

(73) Assignee: Loew-Cornell, Inc., Teaneck, NJ (US)

( * ) Notice: Subject to any disclaimer, the term of this patent is extended or adjusted under 35 U.S.C. 154(b) by 0 days.

(21) Appl. No.: 09/470,704

(22) Filed: Dec. 23, 1999

Related U.S. Application Data

(63) Continuation-in-part of application No. 29/095,872, filed on Oct. 30, 1998, now Pat. No. Des. 420,180.

(51) Int. Cl.[7] ..... B65D 85/20

(52) U.S. Cl. ..... 206/209; 206/1.7; 206/362; 220/523

(58) Field of Search ..... 206/1.7–1.9, 209, 206/362, 373, 575, 213.1; 220/521, 523

(56) References Cited

U.S. PATENT DOCUMENTS

| | | | | |
|---|---|---|---|---|
| D. 301,422 | | 6/1989 | Schmidt . | |
| D. 304,512 | | 11/1989 | Byers et al. . | |
| D. 408,602 | | 4/1999 | Carlson . | |
| D. 420,180 | * | 2/2000 | Mason et al. | D9/424 |
| 695,741 | * | 3/1902 | Lease | 220/523 |
| 2,108,300 | * | 2/1938 | Sullivan | 220/523 |
| 2,766,796 | * | 10/1956 | Tupper | 220/521 |
| 3,543,287 | | 11/1970 | Henkel . | |
| 3,732,972 | | 5/1973 | Israel . | |
| 3,776,371 | * | 12/1973 | Linger | 206/1.7 |
| 3,780,908 | | 12/1973 | Fitzpatrick et al. . | |
| 3,841,466 | | 10/1974 | Hoffman et al. . | |
| 3,885,666 | | 5/1975 | Maxwell . | |
| 4,000,816 | | 1/1977 | Spruyt . | |
| 4,061,224 | | 12/1977 | Fuhri . | |
| 4,091,953 | * | 5/1978 | Daenen | 220/521 |
| 4,166,548 | | 9/1979 | Crisci . | |
| 4,223,800 | * | 9/1980 | Fishman | 220/521 |
| 4,561,562 | | 12/1985 | Trombly . | |
| 4,615,456 | | 10/1986 | Cousar . | |
| 4,809,868 | | 3/1989 | Pomroy . | |
| 4,976,370 | | 12/1990 | Cassel . | |
| 4,981,233 | | 1/1991 | Scheurer . | |
| 5,125,528 | | 6/1992 | Heyn et al. . | |
| 5,147,059 | | 9/1992 | Olsen et al. . | |
| 5,344,007 | | 9/1994 | Nakamura et al. . | |
| 5,348,549 | | 9/1994 | Brown et al. . | |
| 5,353,925 | | 10/1994 | Lennen et al. . | |
| 5,370,263 | | 12/1994 | Brown . | |
| 5,377,860 | | 1/1995 | Littlejohn et al. . | |
| 5,553,701 | | 9/1996 | Jarecki et al. . | |
| 5,555,974 | | 9/1996 | Donald et al. . | |
| 5,624,051 | | 4/1997 | Ahern, Jr. et al. . | |
| 5,715,933 | * | 2/1998 | Monahan | 206/1.7 |
| 5,738,241 | | 4/1998 | McEntee . | |

* cited by examiner

*Primary Examiner*—Jim Foster
(74) *Attorney, Agent, or Firm*—Weingram & Associates, P.C.

(57) ABSTRACT

A container is provided which includes a closed compartment which is formed by a stay wet tray and a cover. The stay wet tray covers a cavity formed in a base. The base includes projecting portions and recesses for supporting and shaping artists' brushes and the stay wet tray facilitates storage of wet palettes, partially completed art work and paper. The cover includes projecting portions which prevent unwanted curling and drying of sheets of paper which are placed on the stay wet tray. A flange around the base adjacent to the cover provides holes for storing brushes.

26 Claims, 8 Drawing Sheets

BRUSH TUB

This application is a continuation-in-part of copending application(s) application Ser. No. 29/095,872 filed on Oct. 30, 1998 U.S. Pat. No. D,420,180.

BACKGROUND OF THE INVENTION

1. Field of the Invention

This invention relates generally to containers and more particularly to a container for holding artists' materials which includes a stay wet base and a cover assembly. The invention functions as a wet storage apparatus enabling extended use of the artist's materials.

2. Description of the Related Art

The prior art includes numerous examples of devices for storage of artists' materials included among which are the devices shown in the following U.S. patents.

U.S. Pat. No. 3,732,972 to Israel discloses a wet palette including a flat base with a peripheral curved wall having an overhang. A wet pad is disposed on the base and beneath the overhang. Pigment containers are held in the overhang along a peripheral area and fit into openings in the pad. One or more water permeable sheets overly the pad, and overhang and surround the pigment containers to provide an area for mixing pigments. A flexible sleeve can enclose the palette to prevent dehydration when not in use. The palette does not have a sealed cover, does not provide a lid for a brush tub and has no prongs for limiting paper movement.

U.S. Pat. No. 3,780,908 to Fitzpatrick et al. discloses a package for dispensing individual wet sheets from a stack. The container has a restricted opening to engage sheets withdrawn from the stack and permits the leading surface of the next sheet to pass through when manually removing the preceding sheet. The container has a resealable cover forming a moisture proof seal. There is no palette holding pigment containers, no wet pad underlying a sheet for mixing pigments and there is no cover provided for the brush tub.

U.S. Pat. No. 3,841,466 to Hoffman et al. discloses a moisture impermeable package for retaining pre-moistened wet wipers. A pivotable lid permits opening of the container which includes a plastic web engaging channels and ledges around the opening. Ribs on the lid engage the plastic web and ledges to provide a moisture proof primary seal. Portions of the web can be opened without removing other portions over the channels, with the ribs of the lid and web providing a secondary seal. This is not a palette for pigment containers, there is no wet pad under a sheet for mixing pigments, and no cover for a brush tub.

U.S. Pat. No. 3,885,666 to Maxwell discloses a container for storing palettes having air drying paints in an air tight manner. The palettes are placed on the bottom of the container with vertical projections from the lid holding the palettes in place. The lid has flanges fitting into channels in the container to provide a moisture proof seal. A wet sponge is secured to the lid to provide moisture to prevent drying of the paints during storage. There is no separate sealed enclosure for a wet pad and permeable palette and no lid for a brush tub.

U.S. Pat. No. 4,000,816 to Spruyt discloses a moisture impervious package enclosing layers of wet paper. A lid is hinged to the body and includes a moisture impervious sheet over the opening of the container. The sheet adheres to the upper surface of the container body and frame to provide a moisture impervious top wall. There is no palette for pigment containers, no wet pad under a sheet for mixing pigments, no separate sealed cover, no vertical prongs to hold the paper, and there is no brush tub.

U.S. Pat. No. 4,061,224 to Fuhri discloses a carrying case for art supplies including an upper section with a plurality of compartments and a cover to close the compartments. The upper section is hinged to a lower section which is open to carry supplies. The cover of the upper section also closes the lower section when the case is closed. There is no moisture proofing provided, no palette or wet pad under a sheet, no prongs to hold paper sheets, and no sealed cover for a brush tub.

U.S. Pat. No. 5,344,007 to Nakamura et al. discloses a resealable package containing layers of wet absorbent sheets with liquid barrier layers therebetween which prevent liquid migration through the stack of sheets. The container is liquid and gas impermeable. There is no palette or wet pad under a sheet for mixing pigments, no prongs for holding sheets, and no sealed cover for a brush tub.

U.S. Pat. No. 5,353,925 to Lennen et al. discloses a container for preserving collectible articles. A front and back panel and spacing sheet provide a cavity for receiving the article. A channel along an edge is formed with a protruding tab to permit circulation of any moisture. A drying agent is added to remove moisture. The container is not sealed against moisture, there is no wet pad or overlying sheet, no pigments on a palette, no separate sealed cover, no prongs for holding paper, and no sealed cover for a brush tub.

U.S. Pat. No. 5,555,974 to Donald et al. describes an enclosure for storing paper palettes with wet mixed paint, a lid for sealing the enclosure and an oxygen scavenging material in an air permeable package attached within the enclosure. The added material absorbs oxygen to prevent paints from drying. The enclosure is made of a neutral color plastic to reflect light evenly to prevent tinting of the paint. A removable tray is included for storing brushes and supplies. The lid has vertical spikes cooperating with flanges on the bottom to hold the palette in place. Vertical ribs prevent lateral movement of the tray. There is no wet pad under a sheet for mixing paints and no separate sealed cover forming a lid for a brush tub.

Among these inventions however, none provide a sealed cover enclosing a stay wet tray which supports an absorbent layer for the purpose of preventing dehydration of pigments and which also provides a lid for a brush tub.

OBJECTS AND SUMMARY OF THE INVENTION

A brush tub is provided which includes a stay wet tray. The stay wet tray is a multifunctional unit which operates as a container for holding coated or artists' paper, as a palette, as a wet tray and as a cover. The stay wet tray covers a brush tub base and seals onto the brush tub base for use as a stay wet palette storage apparatus. An absorbent layer is supported by the stay wet tray. Artist's paper is stored on the absorbent layer. Ribs extend downwards from the cover to limit movement of the paper. The stay wet tray which holds the artists' paper acts as a lid for the brush tub base and prevents spilling of artist's liquids stored therein. The base includes recesses for supporting brushes and an upper flange around the base has apertures for storing the brushes.

It is an object of the present invention to provide a brush tub which is both simple in structure and operation to perform the task of storing coated or artists' paper, pigments and brushes in an effective manner.

Another object of the present invention is to provide a brush tub which is durable and relatively economical to manufacture.

Another object of the present invention is to provide a brush tub which can be used to store coated or artists' paper while restricting the tendency of the coated or artists' paper to curl and become distorted.

Another object of the present invention is to provide a brush tub which includes an absorbent layer in a sealed container for storage of coated paper in a stay wet condition.

Another object of the present invention is to provide a brush tub which provides brush storage space for safe storage of artists' brushes.

Another object of the present invention is to provide a brush tub which provides airtight paint cups and an air tight paint thinner cup.

Another object of the present invention is to provide a brush tub which keeps both oil paints and acrylic paints fresh for extended periods of time.

Another object of the present invention is to provide a brush tub which is relatively light in weight.

Another object of the present invention is to provide a brush tub which is easy to carry.

Another object of the present invention is to provide a brush tub which includes surfaces for shaping artists brushes.

Another object of the present invention is to provide a brush tub with a cover having an integrally formed handle portion for easy opening.

Another object of the present invention is to provide a brush tub which includes integrally formed paint compartments for use as a palette.

Another object of the present invention is to provide a brush tub which incorporates an easily manufactured integrally formed sealing lip.

BRIEF DESCRIPTION OF THE DRAWINGS

For a more complete understanding of the present invention, reference may be had to the following description of exemplary embodiments of the present invention considered in connection with the accompanying drawings, in which.

DETAILED DESCRIPTION OF THE PREFERRED EMBODIMENTS

It will be understood that the embodiments described herein are merely exemplary and that a person skilled in the art may make many variations and modifications without departing from the spirit and scope of the invention. All such modification and variations are intended to be included within the scope of the invention as defined in the appended claims.

Figure 1:
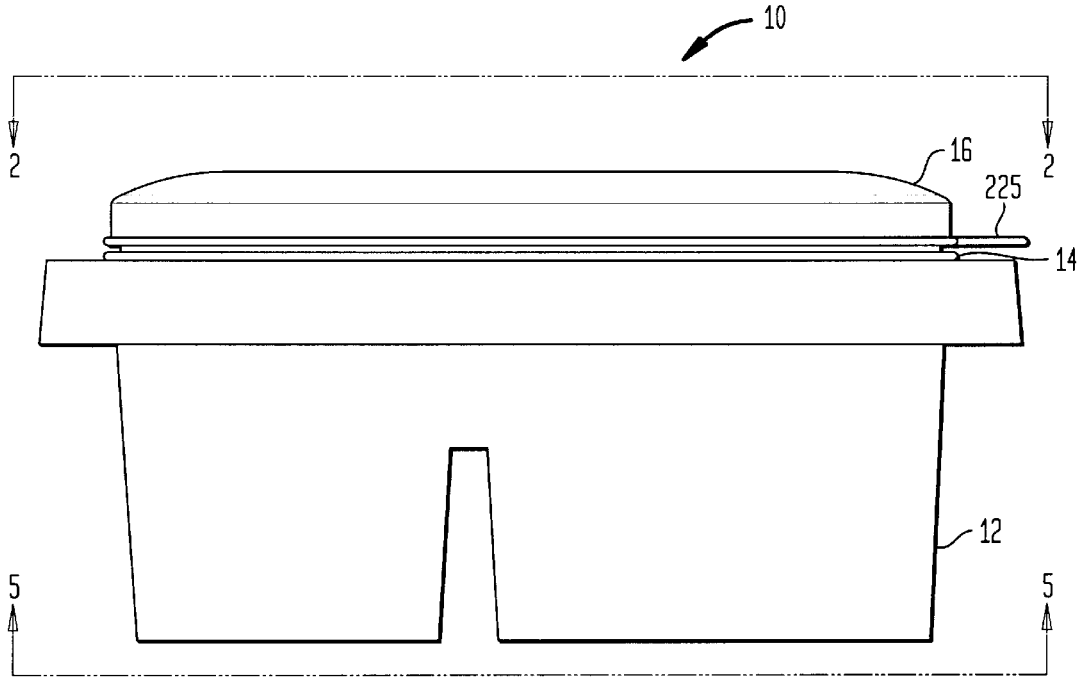
FIG. 1 is a side elevation view of a brush tub according to the present invention.
Figure 2:
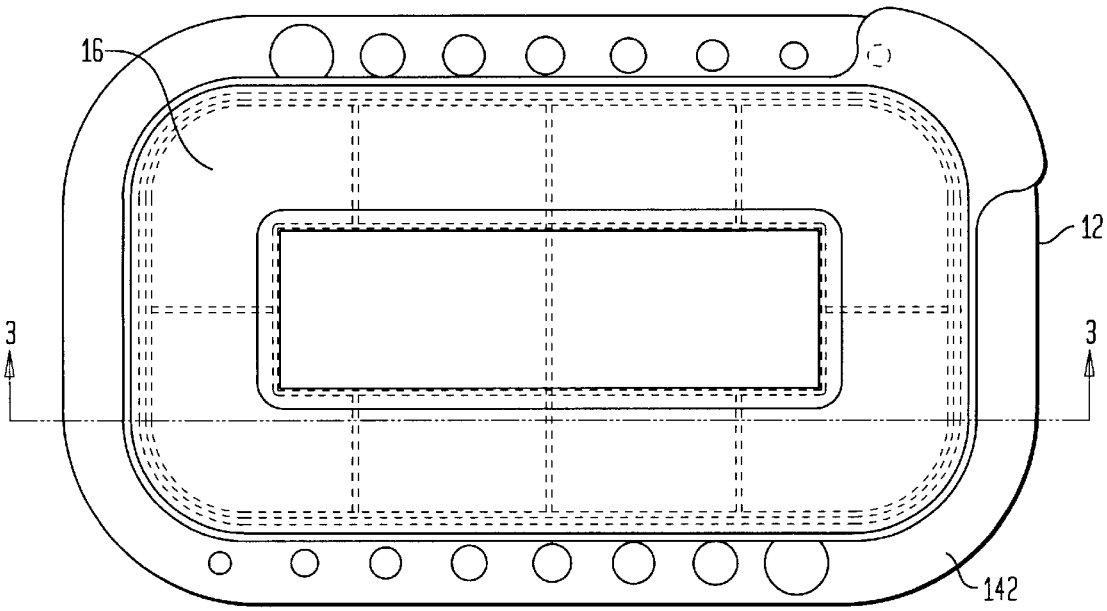
FIG. 2 is a top plan view taken along the Line 2—2 of FIG. 1.

FIG. 1 shows the brush tub 10 of the present invention in a preferred embodiment. The brush tub 10 includes a brush tub base 12, a stay-wet tray 14 and a stay-wet cover 16.

As shown in FIGS. 3–6, the brush tub base 12 is an integrally formed, generally rectangular container which is defined by a pair of relatively longer side walls 18,20, a pair of relatively shorter end walls 22,24, a first bottom panel 26 and a second bottom panel 28. The first and second bottom panels 26,28 are separated by an integrally formed upwardly projecting divider 30 which divides the internal cavity 32 of the brush tub base 12 into a first portion 34 and a second portion 36.

Figure 5:
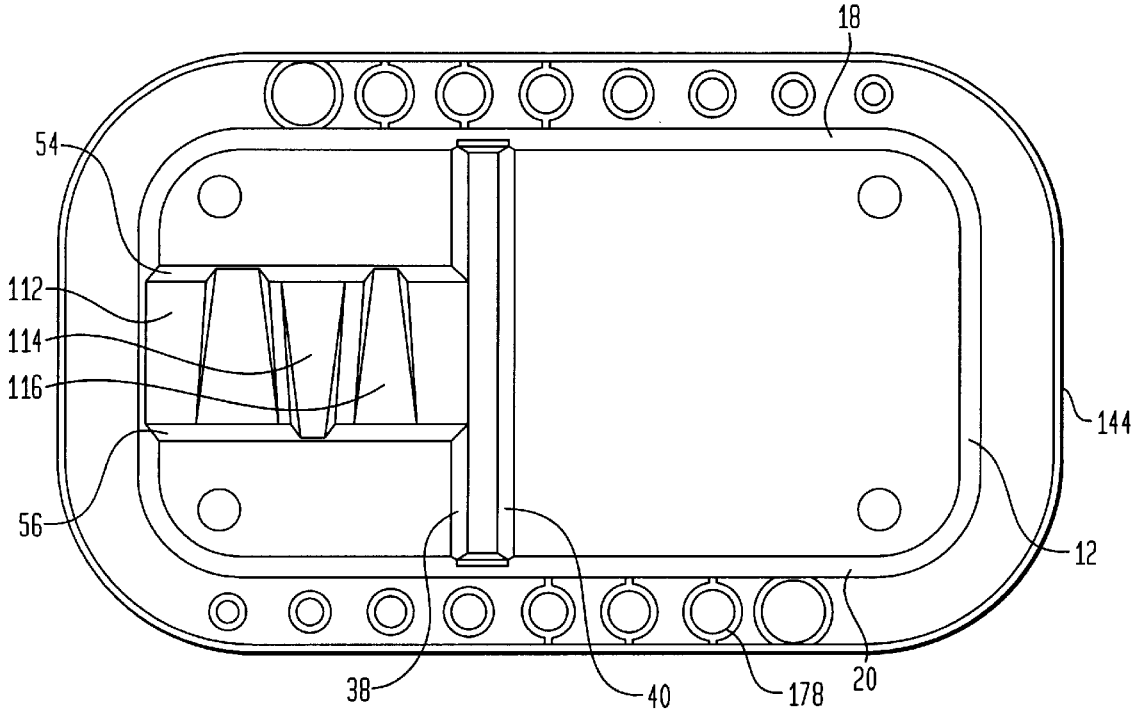
FIG. 5 is a bottom plan view of the brush tub base taken along the line 5—5 of FIG. 1.

The divider 30 is formed by a first generally vertical divider panel 38, a second generally vertical divider panel 40 and a generally horizontal panel 42 which connects the upper edges 44,46 of the first and second divider panels 38,40. As is best shown in FIG. 5, the divider panels 38,40 are connected to the longer side walls 18,20 thereby forming the first and second cavity portions 34,36 of the brush tub base 12.

The first cavity portion 34 includes a plurality of brush support cavity portions 48,50,52 which are formed by a pair of vertical walls 54,56 which project upwardly from bottom panels 26 and a horizontal panel 58 which connects upper edges 60,62 of the vertical walls 54,56 and by tapering wall portions 64,66,68,70, 72,74 which project downwardly from the horizontal wall portions 58. The tapering wall portions 64,66,68,70,72,74 define brush support cavities 48,50,52 each of which have a relatively wider portion 76,78,80 and a relatively narrower portion 82,84,86. As is shown in FIG. 6 the relatively wider portions 76,80 are proximate to the wall 56 while the wider portion 78 is proximate to the wall 54.

Figure 3:
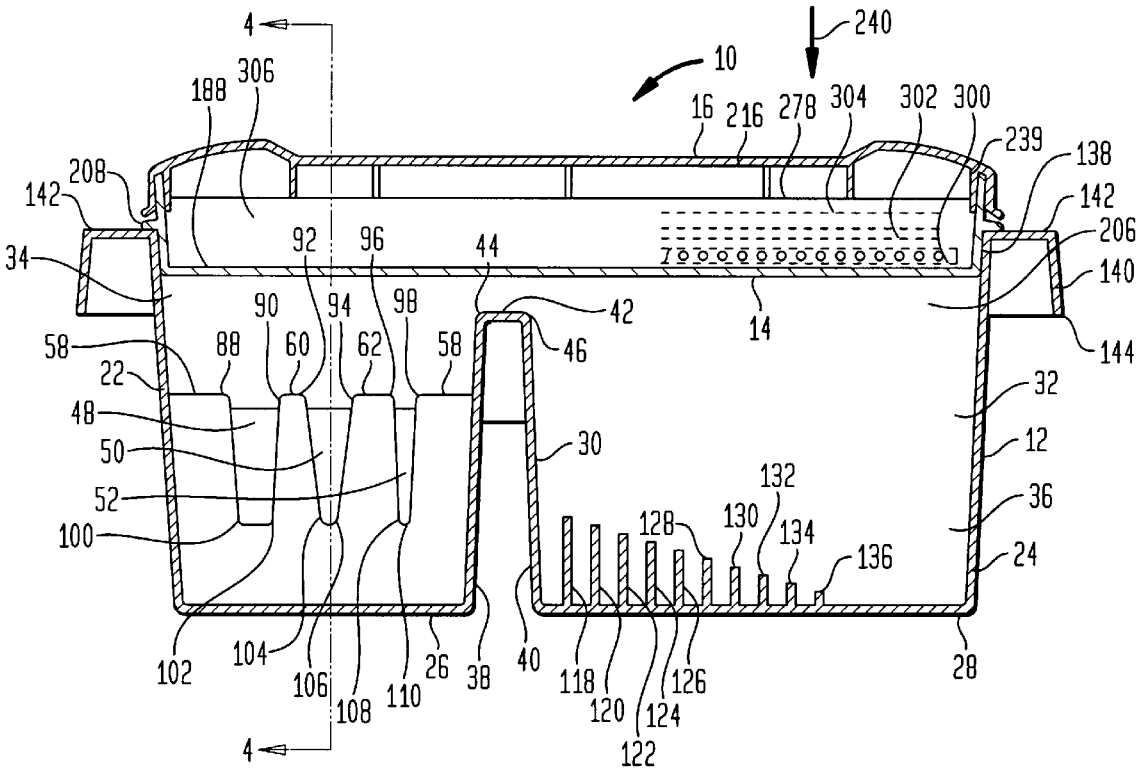
FIG. 3 is a cross-sectional view taken along the Line 3—3 of FIG. 2.

As is best shown in FIG. 3, the tapering wall portions 64,66,68,70,72,74 forming the brush support cavities 48,50, 52 have upper edges 88, 90,92,94,96,98 connected to the horizontal wall 58 which are relatively widely spaced apart thereby forming relatively wider portions of the brush support cavities 48,50,52 and lower edges 100,102,104,106, 108,110 of the tapered wall portions 64,66,68, 70,72,74 which are spaced relatively closer together than the corresponding upper edges thereby forming relatively narrower portions of the brush support cavities 48,50,52. The lower edges 100,102,104,106,108,110 of the tapering wall portions 64,66,68,70,72,74 are connected to bottom panels 112,114, 116 which define the bottom of each of the brush support cavities 48,50,52 as shown in FIG. 5.

Figure 6:
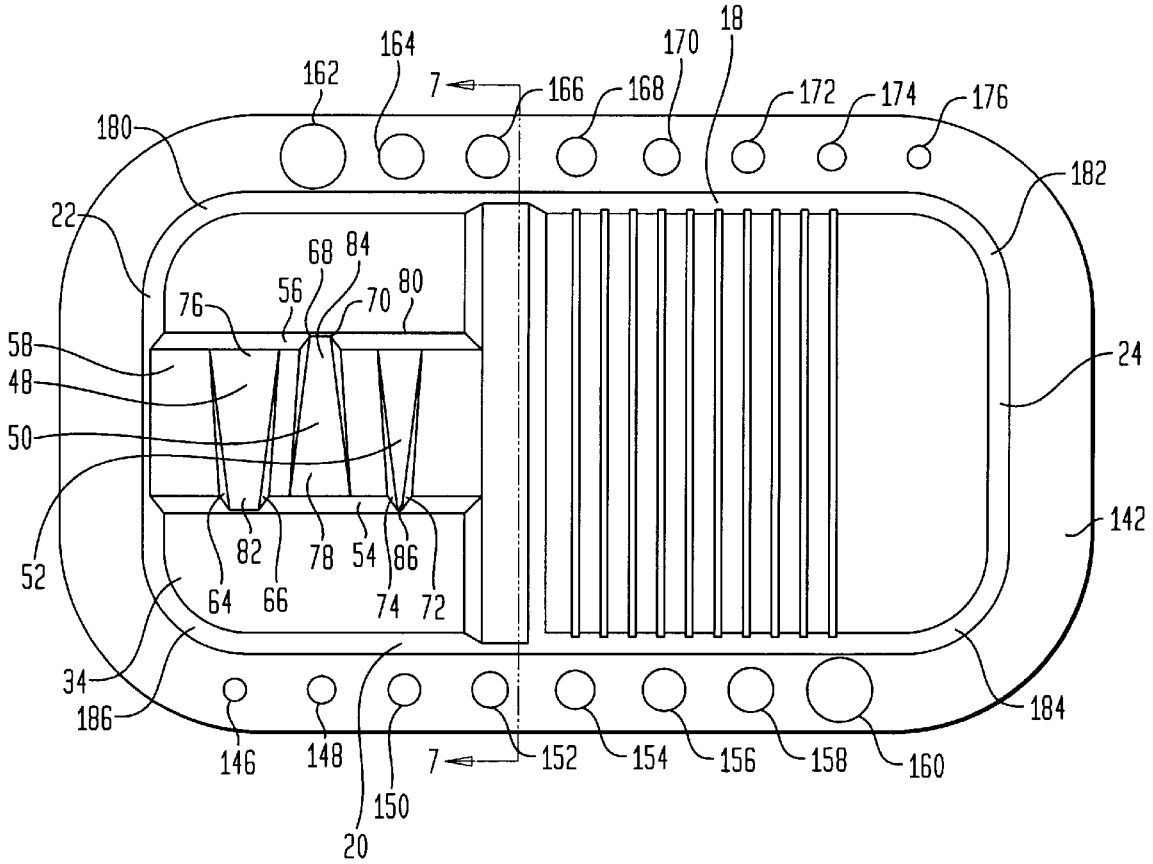
FIG. 6 is a top plan view of the brush tub base.
Figure 7:
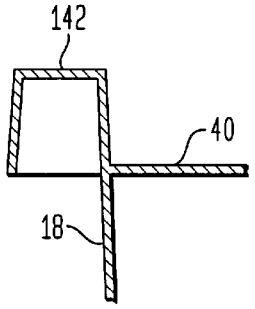
FIG. 7 is a fragmentary cross-sectional view of a base wall and panel portion taken along the line 7—7 of FIG. 6.

The brush support cavities 48,50,52 are thus tapered when viewed as in FIG. 3 and also tapered when viewed as in FIG. 6.

Figure 4:
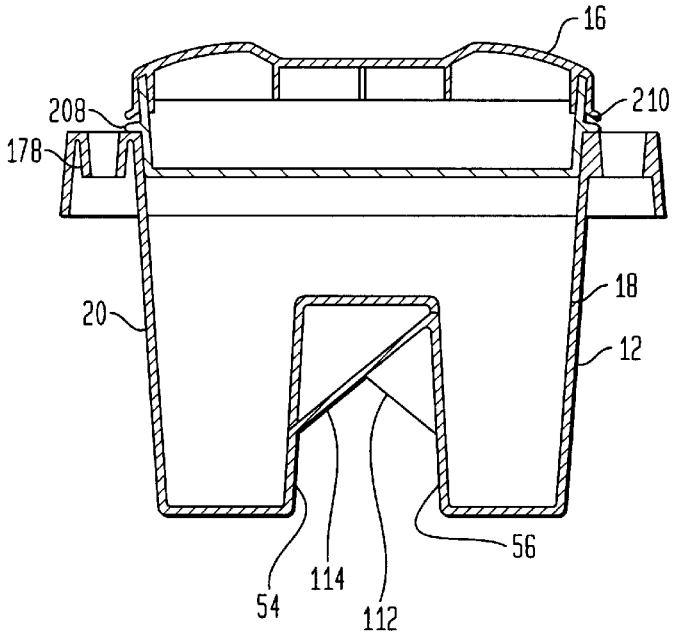
FIG. 4 is a cross-sectional view taken along the line 4—4 of FIG. 3.

In addition, as is best shown in FIG. 4, bottom panel 114, slants downward toward side wall 54 while bottom panels 112, 116 slant downward toward side wall 56.

During use, the tapered configurations of the brush support cavities 48,50,52 facilitate the engagement of the bristles of artists brushes, the shaping of the bristles and the easy removal of the bristles when the brushes are ready for use.

The bottom panel of cavity 36 includes a plurality of integrally formed upwardly projecting walls 118, 120,122, 124, 126,128,130,132,134,136 which are graduated in height with the relatively shortest wall 136 disposed proximate to the end wall 24 and the tallest wall 118 disposed proximate to the divider panel 30. As is best shown in FIG. 6, each of the projecting walls 118,120, 122,124,126,128, 130,132,134,136 are connected to the side wall 18 and the side wall 20.

The graduated configuration of the walls 118,120,122, 124, 126,128,130,132,134,136 facilitates use of the walls in striking off or shaping the ends of artists' brushes prior to use. The tapered brush cavities 48,50,52 facilitate the storage of artists' brushes either in a standing or in an inclined configuration.

As shown in FIG. 3, the upper edge 138 of the brush tub base 12 is connected to an integrally formed flange 140 which includes a horizontal portion 142 and a vertical portion 144. As shown in FIG. 6, the horizontal portion 142 includes a plurality of circular holes 146,148,150,152,154, 156,158,160,162,164,166,168,170,172,174 176 which are graduated in size. Each of the circular holes is defined by an integrally formed collar 178 which projects downwardly from the horizonal flange portion 142 as is best shown in FIG. 5.

The collars 178 facilitate the uses of the plurality of circular holes 146,148,150,152,154,156,158,160,162,164, 166,168,170,172,174,176 for the storage of the artists' brushes or containers of pigment or paint.

As is shown in FIGS. 3 and 4, side and end walls 18,20,22,24 are inclined with respect to the vertical thereby forming a tapered opening at the top of the brush tub base 12. The corners 180,182,184,186 between sidewalls 18,20 and the end walls 22,24 are rounded as is best shown in FIGS. 5 and 6. The function of the tapered configuration of the side and end walls 18,20,22,24 will be explained presently.

Figure 8:
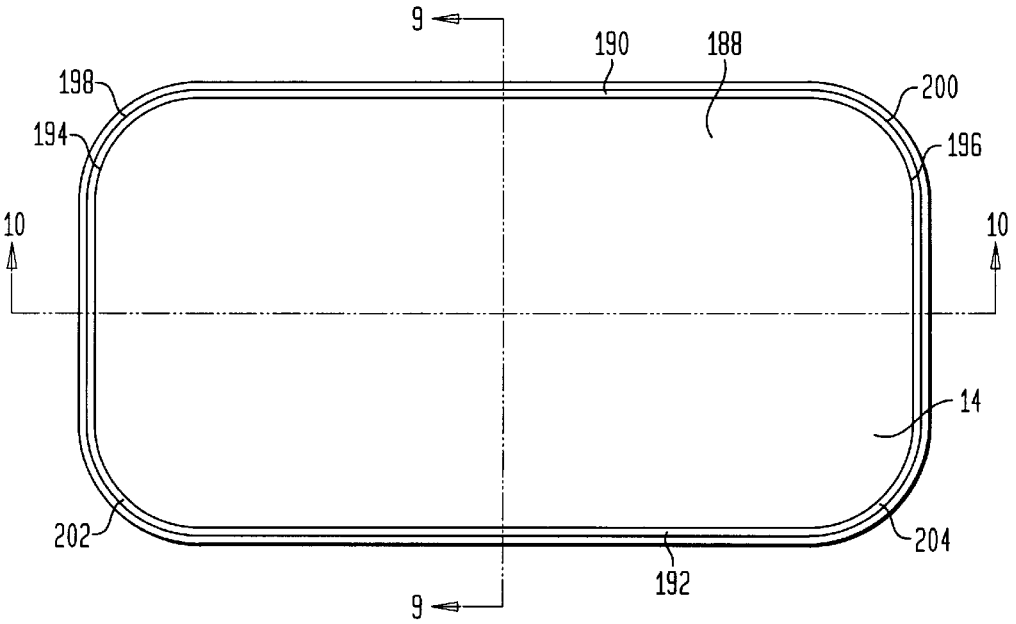
FIG. 8 is a top plan view of the stay wet tray shown removed from the brush tub of FIG. 1.
Figure 9:
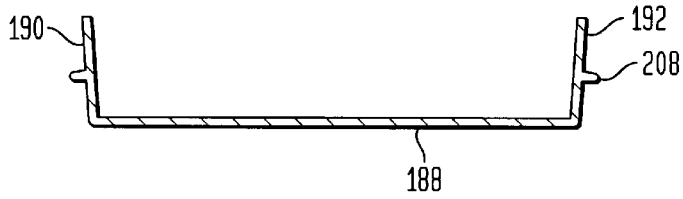
FIG. 9 is a cross-sectional view taken along the line 9—9 of FIG. 8.
Figure 10:
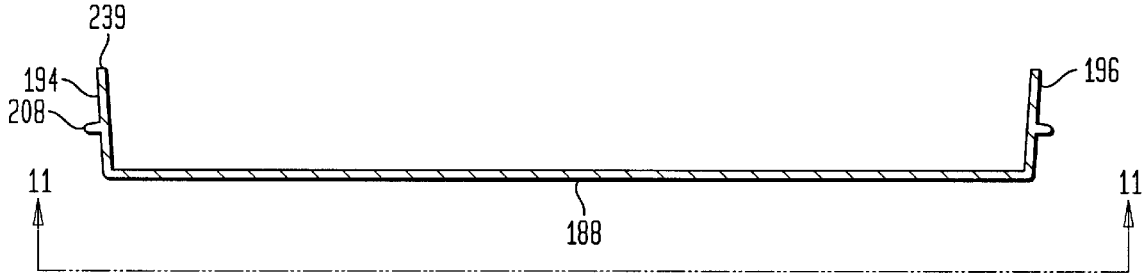
FIG. 10 is a cross-sectional view taken along the line 10—10 of FIG. 8.
Figure 12:
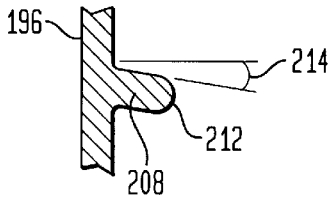
FIG. 12 is a fragmentary cross-sectional view taken along the line 10—10 in FIG. 8 with FIG. 12 drawn to an enlarged scale.
Figure 11:
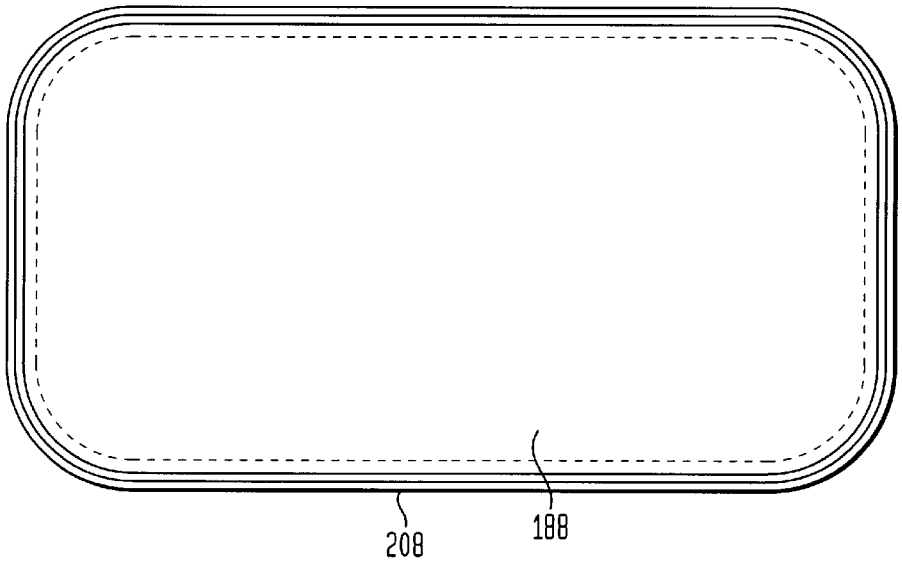
FIG. 11 is a bottom view of the stay-wet tray taken along line 11—11 of FIG. 10.
Figure 13:
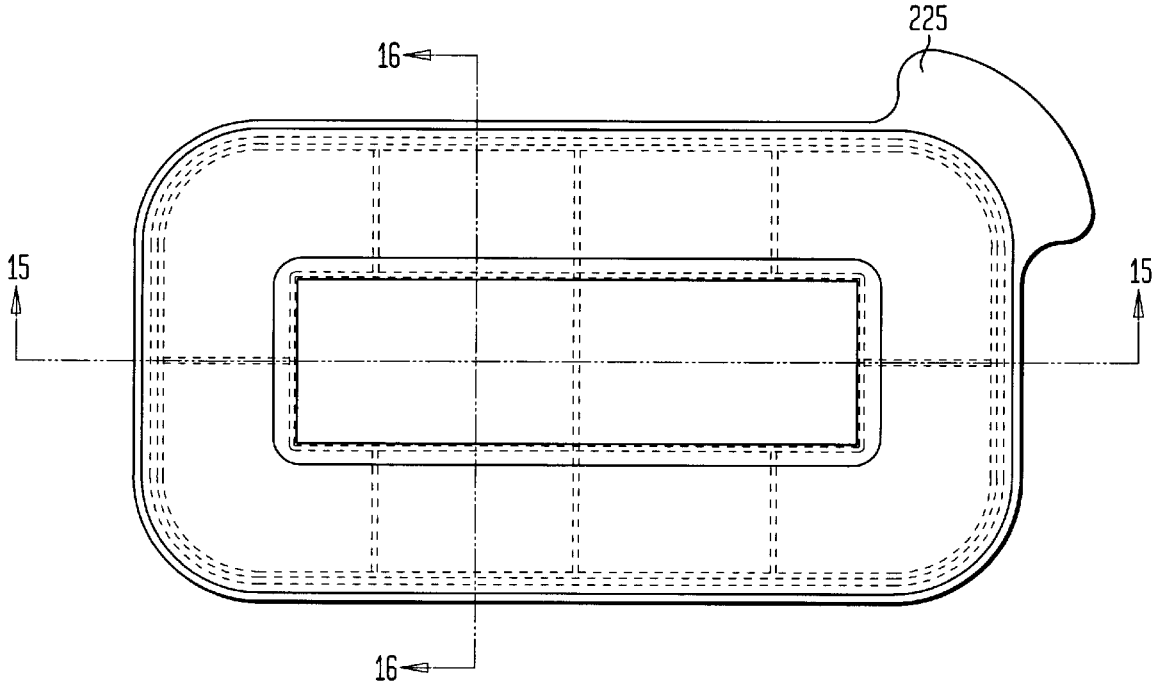
FIG. 13 is a top plan view of the stay-wet cover of the brush tub of FIG. 1.

As shown in FIGS. 8–10, the stay-wet tray 14 includes an integrally formed bottom panel 188, a pair of relatively longer spaced apart side panels 190,192 and a pair of relatively shorter spaced apart end panels 194,196. The side panels 190,192 and end panels 194,196 connected to the bottom panel 188 thereby forming a generally rectangular tray with rounded corners 198,200,202, 204. The side and end panels 190,192,194,196 are disposed tapering toward the bottom panel 188 with the side and end panels and bottom panel 188 proportioned to closely fit the opening 206 in the brush tray base 12 as is shown in FIG. 3. A projecting lip 208 is formed on an intermediate portion 210 of the side and end panels 190,192,194,196. The projecting lip 208 projects in a slightly downward direction as is shown in FIG. 12. When the stay-wet tray 14 is inserted into the brush tub base 12, the outer edge 212 of the projecting lip 208 rests on the horizontal portion 142 of the flange 140. The tapered side and end walls 190,192,194,196 of the stay-wet tray 14 in combination with the projecting lip 208 forms an effective seal between the stay wet tray 14 and the brush tub base 12.

An effective angle of downward projection for the lip 208 has been found to be in the order of ten (10) degrees as defined by the angle identified by the reference numeral 214 in FIG. 12. This angle facilitates a slight flexure of the lip 208 when the stay-wet tray 14 is inserted into the brush tub base 10 thereby facilitating an effective seal.

Figure 14:
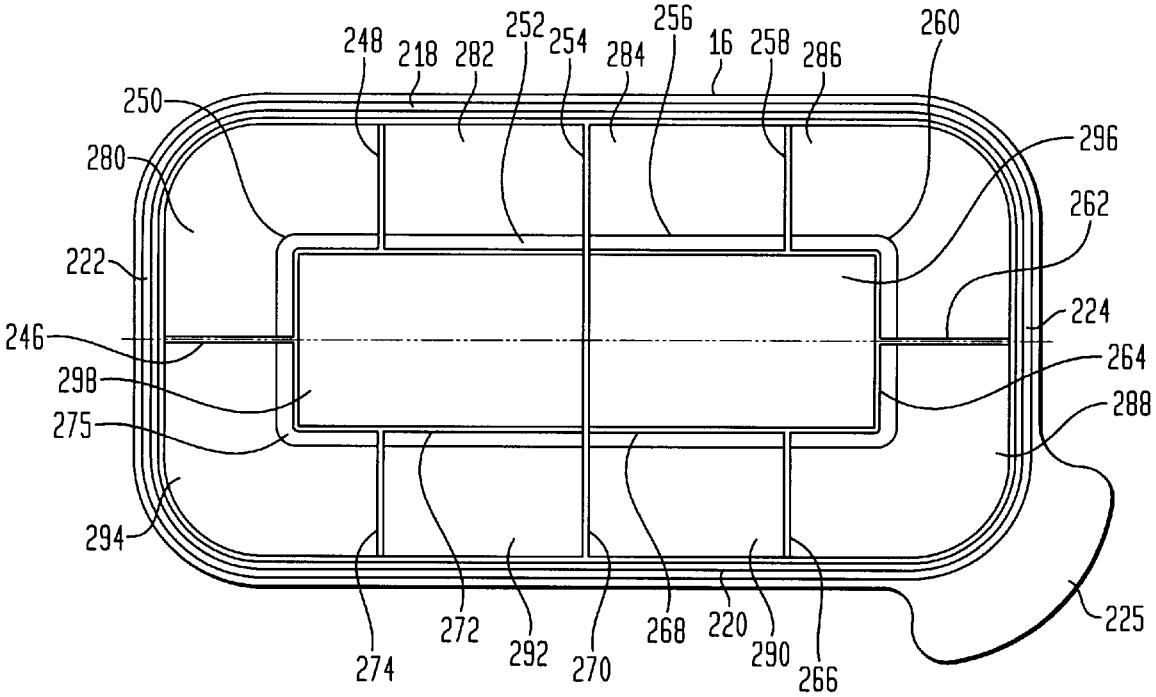
FIG. 14 is a bottom plan view of the stay-wet cover of FIG. 13.
Figure 15:
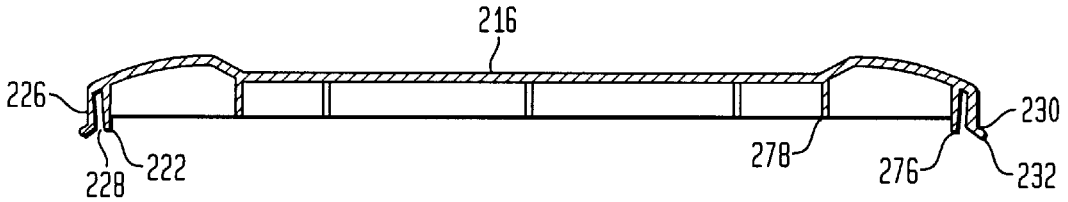
FIG. 15 is a cross-sectional view taken along the line 15—15 of FIG. 13.
Figure 16:
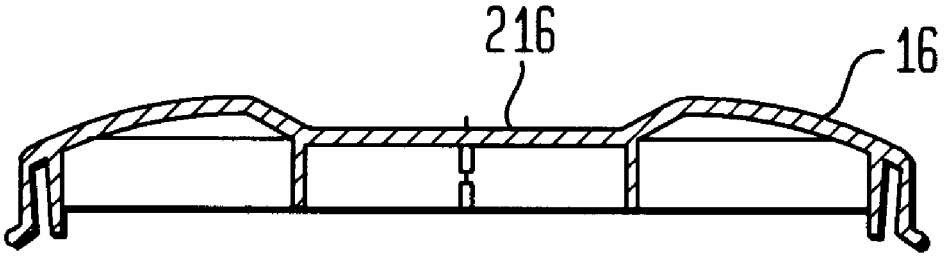
FIG. 16 is a cross-sectional view taken along the line 16—16 of FIG. 13.
Figure 17:
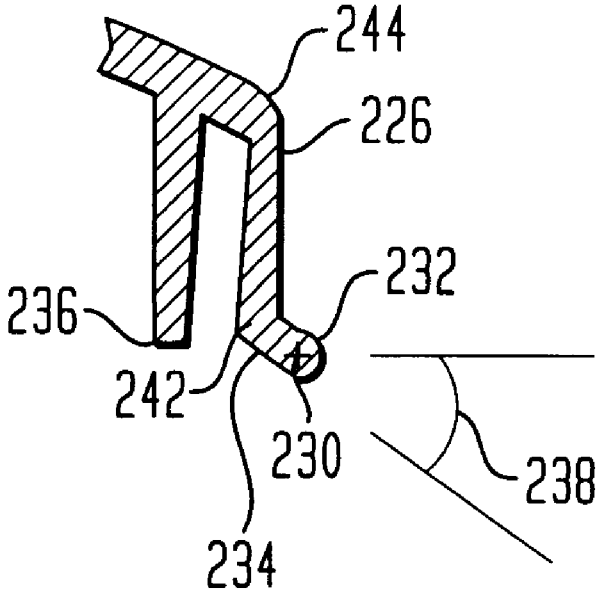
FIG. 17 is a fragmentary cross-sectional view of a cover wall taken along the line 16—16 of FIG. 13 with FIG. 17 drawn to an enlarged scale.

As is best shown in FIGS. 13–17, the stay-wet cover 16 includes an integrally formed top panel 216, a pair of relatively longer side walls 218,220 a pair of relatively shorter end walls 222,224, a handle 225 and a sealing lip 226 which is spaced apart from and is generally parallel to the side and end walls 218,220, 222,224. The space 228 defined by the side and end walls 218, 220,222,224 and the sealing lip 226 closely fits the side and end walls 190,192,194,196 of the stay-wet tray 14 thereby providing an effective seal between the stay-wet cover 16 and the stay wet tray 14. The lower edge 230 of the sealing lip 226 has a projecting flange 232 which projects in an outward direction. As is best shown in FIGS. 15,16 and 17, the bottom surface 234 of the sealing lip 226 projects beyond the lower edge 236 of the side and end walls 218,220,222,224. The bottom surface 234 of the sealing lip is tapered inwardly forming an angle with the horizontal as is defined by the angle designated by the reference numeral 238 in FIG. 17. A preferred value for this angle has been found to be in the order of thirty-five (35) degrees.

The tapered bottom surface 234 of the sealing lip 226 facilitates the engagement of the stay-wet cover 16 on the upper edge 239 of the stay-wet tray 14, as shown in FIG. 3.

Downward manual pressure on the top panel 216 in the direction shown by the arrow 240 in FIG. 3 allows the side and end walls 190,192,194,196 of the stay-wet tray 14 to enter the space 228 thereby providing an effective seal between the stay-wet tray 14 and the stay-wet cover 16.

As is shown in FIG. 17, the lower portion 242 of the sealing lip 226 is thicker than the upper portion 244 thereby enabling the sealing lip 226 to flex and enhancing the sealing capability of the stay-wet cover 16.

The stay-wet cover 16 includes a plurality of integrally formed wall portions or ribs 246,248,250,252,254,256,258, 260, 262,264,266,268,270,272,274,275 which project from the top panel 216 as is shown in FIG. 14. As shown in FIG. 15, the lower edge 276 of the side and end walls 218, 220, 222, 224 projects slightly beyond the lower edges 278 of the wall portions 246,248,250,252, 254,256,258,260,262,264, 266,268,270,272,274,275. As is shown in FIG. 14, the above plurality of the wall portions in combination with the side and end walls 218,220,222,224 and the top panel 216 form a plurality of compartments 280,282,284,286,288,290,292, 294,296,298.

During use, the stay-wet cover 16 may be removed from the stay-wet tray 14, inverted, and the above plurality of compartments may be used for storage of various liquids used in painting such as paints, solvents and thinners.

As shown in FIG. 3, during use a moistened foam or sponge sheet 300 may be placed on the bottom panel 188 of the stay-wet tray 14 and an acrylic film sheet 302 be placed on the foam sheet 300. Sheets of paper 304 may be placed on the acrylic film sheet 302 for the purpose of storage. When the stay-wet cover 16 is installed on the stay-wet tray 14, the stay-wet enclosure 306 formed by the stay-wet cover 16 and the stay-wet tray 14 prevents drying of sheets coated with acrylic paints, oil paints or other media. The walls 246,248,250,252,254,256,258,260,262,264,266, 268,270, 272 of the stay-wet cover take up a significant portion of the space within the stay-wet enclosure 306 and the lower edges 278 of these walls prevent unwanted curling of sheets of paper 304 stored in the stay-wet enclosure 306 and maintain the sheets of paper 304 in flat uncurled condition while preventing unwanted drying of media coating sheets of paper.

The apparatus 10 may be used with or without the foam and acrylic sheets 300,302 in accordance with the artists' media being used. The foam and acrylic sheets 300,302 are typically used for storage of watercolor media and typically not used for storage of oil media.

It will be understood that the embodiments described herein are merely exemplary and that a person skilled in the art may make many variations and modifications without departing from the spirit and scope of the invention. All such modifications and variations of the invention are intended to be covered in the appended claims.

What is claimed is:

1. A brush tub comprising:

a brush tub base including a bottom panel having end and side walls projecting upwardly from said bottom panel, said end and side walls and said bottom panel defining a cavity having an upper opening;

a tray disposed over and enclosing said cavity opening, and a tray cover disposed over and engaging said tray, said tray and tray cover including first sealing means providing a seal between said tray and tray cover, wherein said tray cover includes end and side walls, a plurality of ribs projecting downwardly from the inner surfaces of said cover toward said tray, said ribs being spaced about the inner periphery of the side and end walls of said cover and extending transversely from said cover walls across said inner surfaces and forming a plurality of compartments in said cover.

2. The brush tub according to claim 1 further comprising:

second sealing means providing a seal between the upper portions of said panel end and side walls and said tray.

3. The brush tub according to claim 1 wherein said tray includes end and side walls projecting into said cavity.

4. The brush tub according to claim 3 in which said tray end and side walls fit closely into said end and side walls defining said cavity.

5. The brush tub according to claim 1, in which said tray further includes a flange resting on said upper portions of said cavity side wall.

6. The brush tub according to claim 1 in which said cavity is generally rectangular with rounded corners.

7. The brush tub according to claim 1 in which said tray is generally rectangular with rounded corners.

8. The brush tub according to claim 1 further comprising a flange portion formed on said tray cover.

9. The brush tub according to claim 1 wherein said tray walls include upwardly directed edge portions.

10. The brush tub according to claim 9 in which said tray cover includes a pair of inner and outer spaced apart downwardly projecting wall portions, said upwardly edge portion of said tray being engageable within said cover spaced apart wall portions.

11. The brush tub according to claim 10 wherein said outer wall portion tapers in thickness and having a relatively thinner portion and a relatively thicker portion, said relatively thinner portion engaging the upper edge portions of said tray.

12. The brush tub according to claim 11 in which said tray inner and outer wall portions and said upwardly projecting edge portions of said tray form a seal.

13. The brush tub according to claim 5 wherein said brush tub base includes a flange along the upper portions of said cavity end and side walls and projecting outwardly therefrom, said tray flange resting on said cavity flange.

14. The brush tub according to claim 13 wherein said cavity flange includes a generally horizontal portion, and a generally vertical portion.

15. The brush tub according to claim 14 wherein said horizontal cavity flange portion includes a plurality of openings.

16. The brush tub according to claim 15 wherein said openings include vertical wall portions, said openings and vertical wall portions having varying sizes to receive artists' brushes of different sizes.

17. The brush tub according to claim 1 in which said brush tub base includes a divider separating said cavity into first and second compartments.

18. The brush tub according to claim 17 wherein one of said compartments includes a plurality of ribs projecting upwardly from said bottom panel.

19. The brush tub according to claim 18 in which said plurality of projecting ribs are graduated in height.

20. The brush tub according to claim 17 wherein the second of said compartments includes brush support means projecting upwardly from said bottom panel.

21. The brush tub according to claim 20 in which said brush support means includes a plurality of tapered recesses.

22. The brush tub according to claim 1 wherein said tray includes moisture absorbing means for storing artists' papers in a moist condition.

23. The brush tub according to claim 22 wherein said moisture absorbing means is a sponge pad and including an acrylic film supported by said sponge pad.

24. The brush tub according to claim 23 wherein said downwardly projecting ribs of said tray cover engage said artists papers to prevent curling and drying.

25. The brush tub according to claim 1 wherein said tray cover includes a handle.

26. A brush tub comprising:

a container having a bottom panel and end and sidewalls extending upwardly from said panel and forming an open cavity;

a divider projecting upwardly from said bottom separating said bottom panel into first and second compartments, one of said compartments including a plurality of ribs of graduated heights projecting upwardly from said panel, the other of said compartments including a plurality of upwardly projecting spaced tapered walls and recesses of varying widths for receiving artists brushes;

a tray having a bottom and end and sidewalls fitting closely into and over said open cavity and having a flange supported on and engaging the upper edges of said container walls, said tray including a moisture absorbing pad and an acrylic film for storing artists papers in a moist condition;

a tray cover having top and end and side walls fitting over the upper edges of said tray walls, said tray cover having closely spaced inner and outer walls receiving the upper edges of the tray walls and providing a seal therebetween, a plurality of ribs projecting downwardly from the top wall of said tray cover onto said artists papers for preventing curling and drying of said papers; and a flange extending around the upper portions of said container end and sidewalls, said flange including a plurality of openings having vertical wall portions, said openings and vertical wall portions having varying sizes to receive artists brushes of different sizes.

* * * * *